US007044630B1

(12) United States Patent
Hawkins

(10) Patent No.: US 7,044,630 B1
(45) Date of Patent: May 16, 2006

(54) COUNTER-FLOW ASPHALT PLANT METHOD

(76) Inventor: Michael R. Hawkins, 10735 NE. 112th St., Kansas City, MO (US) 64157

( * ) Notice: Subject to any disclaimer, the term of this patent is extended or adjusted under 35 U.S.C. 154(b) by 168 days.

(21) Appl. No.: 10/750,927

(22) Filed: Jan. 2, 2004

Related U.S. Application Data

(62) Division of application No. 09/764,687, filed on Jan. 18, 2001, now Pat. No. 6,672,751.

(51) Int. Cl.
*B28C 5/20* (2006.01)
*B28C 5/46* (2006.01)

(52) U.S. Cl. ..... 366/7; 366/25; 34/137; 432/111

(58) Field of Classification Search ..... 366/7, 366/23, 25; 34/137; 432/111
See application file for complete search history.

(56) References Cited

U.S. PATENT DOCUMENTS 4,481,039 A * 11/1984 Mendenhall ..... 106/281.1
4,787,938 A * 11/1988 Hawkins ..... 106/281.1
4,955,722 A * 9/1990 Marconnet ..... 366/25
5,470,146 A * 11/1995 Hawkins ..... 366/25
5,664,881 A * 9/1997 Hawkins et al. ..... 366/4
5,664,882 A * 9/1997 Green et al. ..... 366/25
6,672,751 B1 * 1/2004 Hawkins ..... 366/25

* cited by examiner

*Primary Examiner*—David Sorkin
(74) *Attorney, Agent, or Firm*—Joseph B Bowman

(57) ABSTRACT

A method for operating a counter-flow aggregate dryer for an asphalt plant in which primary aggregate materials are introduced into a first end of a horizontally rotating cylinder and travel to the second, discharge end of the cylinder through drying and combustion zones. Hot gases are generated in the combustion zone to flow in counter-current heat exchange relationship with the aggregate materials for discharge from the first end of the cylinder to air pollution control equipment. Secondary materials like RAP or virgin aggregates are fed directly into the combustion zone. The discharge gas stream is heated above its dew point prior to delivery to air pollution control equipment.

16 Claims, 10 Drawing Sheets

ROTARY MIXER
OR
BATCH PLANT PUGMILL MIXER
OR
CONTINUOUS PUGMILL MIXER
OR
OTHER MIXING DEVICE
110
112
114
116
50
52
54
56
58
59
60
61
62
64
68
69
70
72
75
76
77
78
80
88
90
92
94
95
96

COUNTER-FLOW ASPHALT PLANT METHOD

CROSS-REFERENCE TO RELATED APPLICATIONS

This application is a divisional application of nonprovisional application Ser. No. 09/764,687, filed Jan. 18, 2001 and issued Jan. 6, 2004 as U.S. Pat. No. 6,672,751.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a counter-flow asphalt plant used to produce a variety of asphalt compositions. More specifically, this invention relates to a counter-flow asphalt plant having a recycle asphalt (RAP) feed to the combustion zone to produce high percentage RAP mixes without generating excessive blue smoke and having an exhaust gas heater to improve production rates with greater economy and efficiency of plant design and operation.

Several techniques and numerous equipment arrangements for the preparation of asphaltic cement, also referred by the trade as "hotmix" or "HMA", are known from the prior art. Particularly relevant to the present invention is the continuous production of asphalt compositions in a drum mixer asphalt plant. Typically, water-laden virgin aggregates are dried and heated within a rotating, open-ended drum mixer through radiant, convective and conductive heat transfer from a stream of hot gases produced by a burner flame. As the heated virgin aggregate flows through the drum mixer, it is combined with liquid asphalt and mineral binder to produce an asphaltic composition as the desired end-product. Optionally, prior to mixing the virgin aggregate and liquid asphalt, reclaimed or recycled asphalt pavement (RAP) may be added once it is crushed up or ground to a suitable size. The RAP is typically mixed with the heated virgin aggregate in the drum mixer at a point prior to adding the liquid asphalt and mineral fines.

The asphalt industry has traditionally faced many environmental challenges. The drum mixer characteristically generates, as by-products, a gaseous hydrocarbon emission (known as blue smoke), various nitrogen oxides ($NO_X$) and sticky dust particles covered with asphalt. Early asphalt plants exposed the liquid asphalt or RAP material to excessive temperatures within the drum mixer or put the materials in close proximity with the burner flame which caused serious product degradation. Health and safety hazards resulted from the substantial air pollution control problems due to the blue-smoke produced when hydrocarbon constituents in the asphalt are driven off and released into the atmosphere. The exhaust gases of the asphalt plant are fed to air pollution control equipment, typically a baghouse. Within the baghouse, the blue-smoke condenses on the filter bags and the asphalt-covered dust particles stick to and plug-up the filter bags, thereby presenting a serious fire hazard and reducing filter efficiency and useful life. Significant investments and efforts were previously made by the industry in attempting to control blue-smoke emissions attributed to hydrocarbon volatile gases and particulates from both the liquid asphalt and recycle material.

The earlier environmental problems were further exacerbated by the processing technique standard in the industry which required the asphalt ingredients with the drum mixer to flow in the same direction (i.e., co-current flow) as the hot gases for heating and drying the aggregate. Thus, the asphalt component of recycle material and liquid asphalt itself came in direct contact with the hot gas stream and, in some instances, even the burner flame itself.

Many of the earlier problems experienced by asphalt plants were solved with the development of modern day counter-flow technology as disclosed in my earlier patent Hawkins U.S. Pat. No. 4,787,938 which is incorporated herein by reference and which was first commercially introduced by Standard Havens, Inc. in 1986. The asphalt industry began to standardize on the counter-flow processing technique in which the ingredients of the asphaltic composition and the hot gas stream flow through a single, rotating drum mixer in opposite directions. Combustion equipment extends into the drum mixer to generate the hot gas stream at an intermediate point within the drum mixer. Accordingly, the drum mixer includes three zones. From the end of the drum where the virgin aggregate feeds, the three zones include a drying/heating zone to dry and heat virgin aggregate, a combustion zone to generate a hot gas stream for the drying/heating zone, and a mixing zone to mix hot aggregate, recycle material and liquid asphalt to produce an asphaltic composition for discharge from the lower end of the drum mixer.

Not only did the counter-flow process with its three zones vastly improve heat transfer characteristics, more importantly it provided a process in which the liquid asphalt and recycle material were isolated from the burner flame and the hot gas stream generated by the combustion equipment. Counter-flow operation represented a solution to the vexing problem of blue-smoke and all the health and safety hazards associated with blue-smoke.

A more complete understanding of the early equipment and processing techniques used by the asphalt industry can be found in the extensive listing of prior art patents and printed publications contained in my earlier patents Hawkins U.S. Pat. No. 5,364,182 issued Nov. 15, 1994, Hawkins U.S. Pat. No. 5,470,146 issued Nov. 28, 1995, and Hawkins U.S. Pat. No. 5,664,881 issued Sep. 9, 1997. Indeed, as a result of my first patent Hawkins U.S. Pat. No. 4,787,938 becoming involved in protracted litigation, the prior art collection cited in the foregoing patents is thought to be a thorough and exhaustive bibliographic listing of asphalt technology and such prior art is specifically incorporated herein by reference.

With many of the health and safety issues associated with asphalt production solved by the advent of counter-flow technology, contemporaneous attention has now shifted to operational inefficiencies which are manifest as excessive design and production costs and poor economy of operation from excess energy consumption.

Experience has shown that the environmentally desirable use of a recycled material (RAP) in asphalt production comes with disadvantageous tradeoffs in energy consumption. The most energy efficient plant operation is achieved when no RAP is added. In such circumstances, for example, all virgin aggregate is introduced in one end of the dryer and flows as a falling curtain or veil of material in counter-current heat exchange with hot gases generated at the opposite end of the dryer. The shell temperature is characteristically about 500° F. and the exhaust gas is about 225° F. which is within the normal operating temperature for the baghouse used to filter the exhaust gas of particulate matter.

The temperature of the exhaust gas stream is determined by the design of the dryer, but must be kept above dew pont to prevent moisture from condensing in the exhaust ductwork and especially in the baghouse itself. A temperature of 225° F. is sufficient, but since varying conditions during operation can cause relatively large temperature swings, most operations are controlled to keep exhaust temperatures in the range of 250° F. to 275° F.

The addition of RAP material has a significant effect on operating temperatures of the process. Since RAP cannot be directly dried without burning the liquid asphalt and causing hydrocarbon smoke emissions, it is dried indirectly by superheating the virgin aggregates and then mixing the superheated aggregates with the RAP to achieve a mixed mixture temperature. This results in much higher exhaust gas temperatures and a resulting loss in fuel efficiency. Accordingly, 20 TO 40% RAP feeds (that is, operations wherein RAP makes up 20 to 40% of the final asphalt composition) have been close to the upper end of the range heretofore workable in modern counter-flow asphalt plants. Although a 50% RAP feed has been achievable, it has been at the cost of high energy and reduced equipment life. Consequently, an upper limit of approximately 40% RAP has been a realistic upper limit for the majority of asphalt plants. The operating conditions necessary are illustrative of the problems. If 50% RAP is introduced midstream in the process, then only 50% virgin aggregates are used. This means that only half the material is present, as compared to the 100% virgin aggregate production, to be heated and only half the veiling of material in the drying section of the drum occurs which yields poor heat transfer characteristics. Under such circumstances, the combustion zone temperature must be elevated significantly to superheat the virgin aggregate. This, in turn, causes the shell temperature of the drum to range from 750–800° F. and the exhaust gas temperature to increase to about 375° F. The exhaust gas temperature will now exceed the upper limit for a baghouse using polyester bags which have an upper service of about 275° F. Accordingly, more costly filter bags constructed of less heat sensitive material such as NOMEX (an aramid fiber marketed by DuPont) have to be installed in the baghouse whenever higher RAP feed operations are contemplated. Moreover, any time the combustion zone temperature rises to about 2800° F. or greater then the production of various nitrogen oxides (NOx) as a product of combustion becomes a problem.

A need remains in the industry for an improved counter-flow asphalt plant design capable of utilizing high percentage RAP mixes and for operating techniques to address the problems and drawbacks heretofore experienced with modern counter-flow production. The primary objective of this invention is to meet this need.

SUMMARY OF THE INVENTION

More specifically, an object of the invention is to provide a counter-flow asphalt plant capable of routinely using high percentage RAP mixes (e.g., up to 50% RAP) without emitting excessive blue smoke or without excessive energy requirements.

Another object of the invention is to provide a counter-flow asphalt plant capable of processing up to 50% RAP mixes with extended equipment life by eliminating the need to superheat virgin aggregates with the associated temperature elevation of the processing equipment.

An alternative object of the invention is to provide a counter-flow asphalt plant capable of processing RAP mixes greater than 50% by utilizing superheating techniques together with the processing techniques which are the subject of this invention.

An additional object of the invention is to provide a counter-flow batch plant dryer for processing up to 50% RAP mixes without emitting excessive blue smoke.

Another object of the invention is to provide counter-flow drum mixer or batch plant dryer equipment and method of operation for retrofitting existing asphalt plants to increase production capacity by reducing the total volume and temperature of the combustion gases present in the equipment for a given production rate.

A corollary object of the invention is to provide counter-flow drum mixer or batch plant dryer equipment and method of operation of the character previously described for retrofitting existing asphalt plants to increase production capacity by as much as 20%.

An additional object of the invention is to provide counter-flow drum mixer or batch plant dryer equipment of a reduced size for a given production rate for savings in original equipment costs, as well as savings in operating costs, by reducing the total volume and temperature of the combustion gases necessary to achieve a given production rate in a conventional counter-flow plant.

A corollary object of the invention is to provide counter-flow drum mixer or batch plant dryer equipment and method of operation of the character previously described that reduces by as much as 20% the size of the equipment required to produce a given volume of product.

A further object of the invention is to provide a counter-flow drum mixer or batch plant dryer equipment with specially designed combustion zone flighting to permit RAP material to be introduced into the drum between the ends of the combustion zone.

Another object of the invention is to provide equipment and methods of operation to permit RAP material to be introduced into an asphalt plant drum between the ends of the combustion zone, to be shielded from direct radiant heat to minimize blue smoke production, and to permit any blue smoke which is formed to be incinerated in the remainder of the combustion zone.

Yet another object of the invention is to provide counter-flow drum mixer or batch plant dryer equipment and method of operation for reducing $NO_X$ emissions for processing techniques utilizing both virgin material mixes and RAP with virgin material mixes.

An additional object of the invention is to provide counter-flow drum mixer or batch plant dryer equipment and method of operation which both reduces in size and operates more economically the air handling equipment and dust collection system required for asphalt production.

Another object of the invention is to provide counter-flow drum mixer or batch plant dryer equipment and method of operation for which the exhaust gas temperatures are substantially lower than in conventional systems (225 F. average vs. 375 F. average in a typical 50% recycle plant) to permit the use of polyester filters in the dust collection system for a savings of 80% in filter cost over conventional systems.

A further object of the invention is to provide a counter-flow asphalt plant of the character described having improved efficiency of operation and production consistency of finished product conforming to specifications.

An additional object of the invention is to provide a counter-flow asphalt plant of the character described having more precise control over operating parameters to achieve a uniform end-product and more precise control over energy requirements for improved economic operation.

An added object of the invention is to provide a counter-flow asphalt plant of the character described which meets or exceeds modern day environmental standards.

A further object of the invention is to provide a counter-flow asphalt plant of the character described which is both safe and economical in operation. Efficient operation results in improved fuel consumption and in reduced air pollution emissions.

Other and further objects of the invention, together with the features of novelty appurtenant thereto, will appear in the detailed description of the drawings.

In summary, a counter-flow aggregate dryer for an asphalt plant is equipped with a secondary feeder for introducing RAP or virgin materials intermediate the ends of the combustion zone of the dryer. Nonveiling flights in the combustion zone shield material carried through the combustion zone from direct radiant heat and veiling flights in the drying zone create a curtain of falling aggregates heated by a hot gas stream flowing in a countercurrent direction from a primary burner. A secondary burner elevates the temperature of the exhaust gas above its dew point temperature before delivery to the baghouse.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
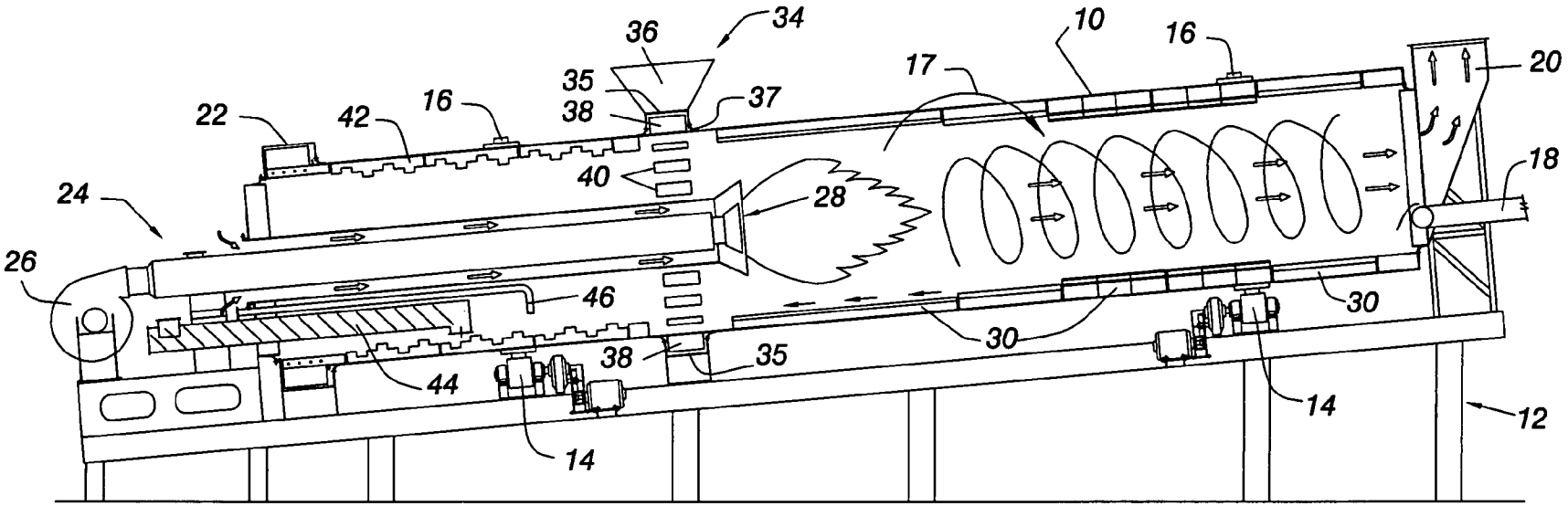
Fig. 1 PRIOR ART
FIG. 1 is a side sectional view of a prior art counter-flow asphalt plant in order to compare and contrast the teachings of this invention.

Referring now to the drawings in greater detail, attention is first directed a modern day counter-flow asphalt plant as shown in the prior art illustration of FIG. 1 for the purpose of subsequently comparing and contrasting the structure and operation of an asphalt plant constructed in accordance with this invention as illustrated in FIGS. 2–20. The prior art asphalt plant of FIG. 1 is shown and described in greater detail in Hawkins U.S. Pat. No. 4,787,938 incorporated herein by reference.

The prior art counter-flow plant includes a substantially horizontal, single drum mixer 10 carried by a ground engaging support frame 12 at a slight angle of declination, typically about 5 degrees. Mounted on the frame 12 are two pairs of large, motor driven rollers 14 which supportingly receive trunnion rings 16 secured to the exterior surface of the drum mixer 10. Thus, rotation of the drive rollers 14 engaging the trunnion rings 16 causes the drum mixer 10 to be rotated about its central longitudinal axis in the direction of the rotational arrow 17.

Located at the inlet or upstream end of the drum mixer 10 is an aggregate feeder 18 to deliver aggregate to the interior of the drum mixer 10 from a storage hopper or stockpile (not shown). The inlet end of the drum mixer 10 is closed by a flanged exhaust port 20 leading to conventional air pollution control equipment (not shown), such as a baghouse, to remove particulates from the gas stream.

Located at the outlet end of the drum mixer 10 is a discharge housing 22 to direct asphaltic composition from the drum mixer 10 to a material conveyor (not shown) for delivery of the final product to a storage bin or transporting vehicle.

A combustion assembly 24 extends through the discharge housing 22 and into the drum mixer 10 to deliver fuel, primary air from a blower 26 and induced secondary air through an open annulus to a burner head 28. Combustion at the burner head 28 generates a hot gas stream which flows through the drying zone of the drum mixer 10. Within the drying zone are fixed various types of flights or paddles 30 for the alternative purposes of lifting, tumbling, mixing, and moving aggregate within the drum mixer 10 to facilitate the drying and heating of the aggregate therein.

Downstream of the burner head 28 is located the recycle feed assembly 34 by which recycle asphalt material may be introduced into the drum mixer 10. A stationary box channel 35 encircles the exterior surface of the drum mixer 10 and includes a feed hopper 36 providing access to the interior of the box channel 35. Bolted to the side walls of the box channel 35 are flexible seals 37 to permit rotation of the drum mixer 10 within the encircling box channel 35. Secured to the outer wall of the drum mixer 10 and projecting into the space defined by the box channel 35 are a plurality of scoops 38 radially spaced around the drum mixer 10. At the bottom of each scoop 38 is a scoop opening 40 through the wall of the drum mixer 10 to provide access to the interior of drum mixer 10. Thus, recycle asphalt material may be delivered by conveyor (not shown) through the feed hopper 36, into the box channel 35 and subsequently introduced into the interior of the drum mixer 10 through the scoop openings 40.

Downstream of the recycle feed assembly 34 is a mixing zone within the drum mixer 10. Mounted on the interior thereof are staggered rows of sawtooth flighting 42 to mix and stir material within the annulus of the drum mixer 10 and combustion assembly 24. A conveyor 44 extends into the drum mixer 10 for feeding binder material or mineral "fines" to the mixing zone. Likewise extending into the drum mixer 10 is an injection tube 46 for spraying liquid asphalt into the mixing zone. At the end of the mixing zone is located the discharge housing 22 as previously discussed through which the asphaltic product is discharged.

Figures 2, 4:
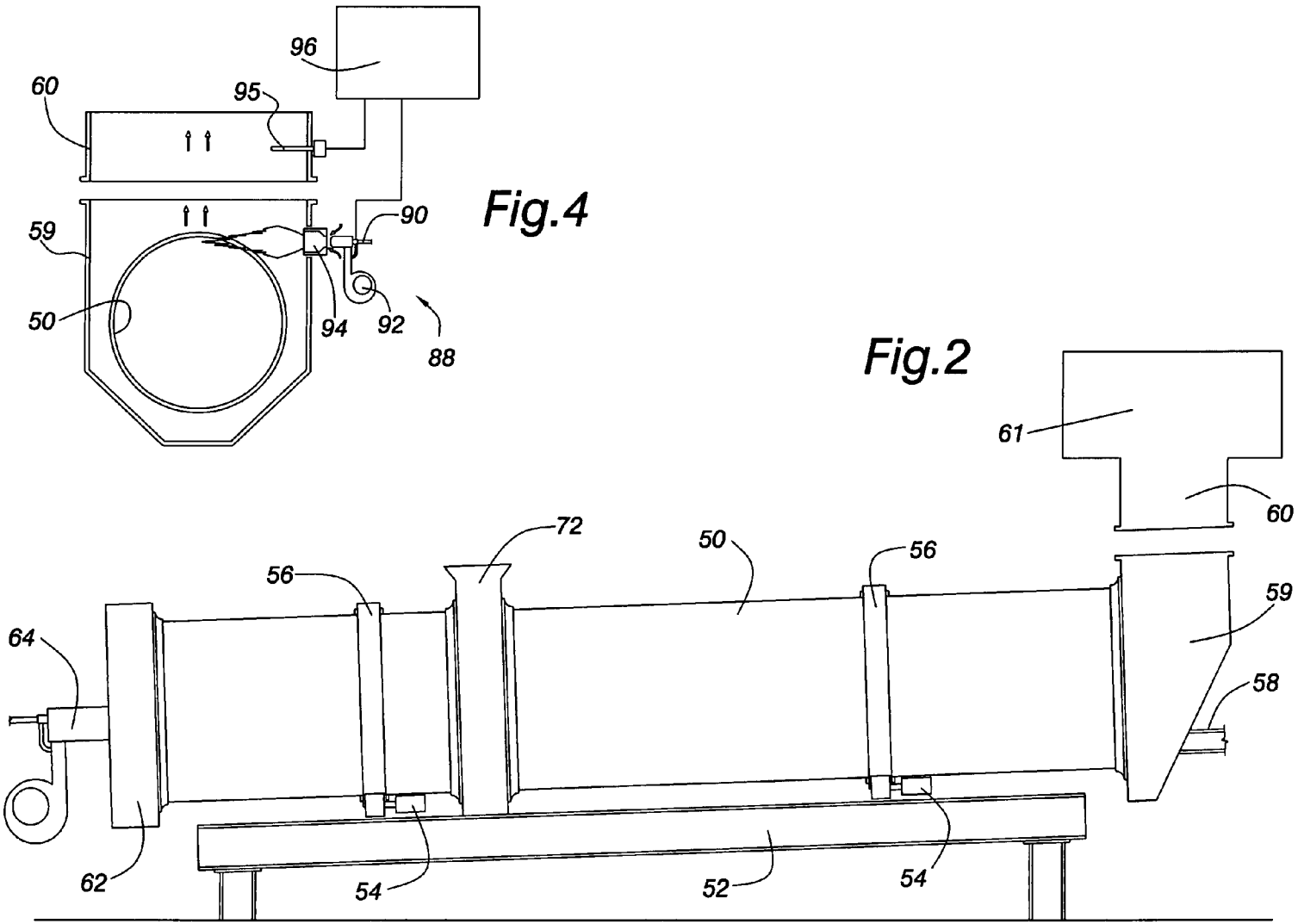
FIG. 2 is a side view of a single drum, counter-flow asphalt plant constructed in accordance with a first preferred embodiment of the invention.
FIG. 4 is an end sectional view of a portion of the exhaust ductwork, the associated exhaust gas heater and a schematic illustration of the temperature control system as taken from the right hand end of FIG. 3.
Figure 3:
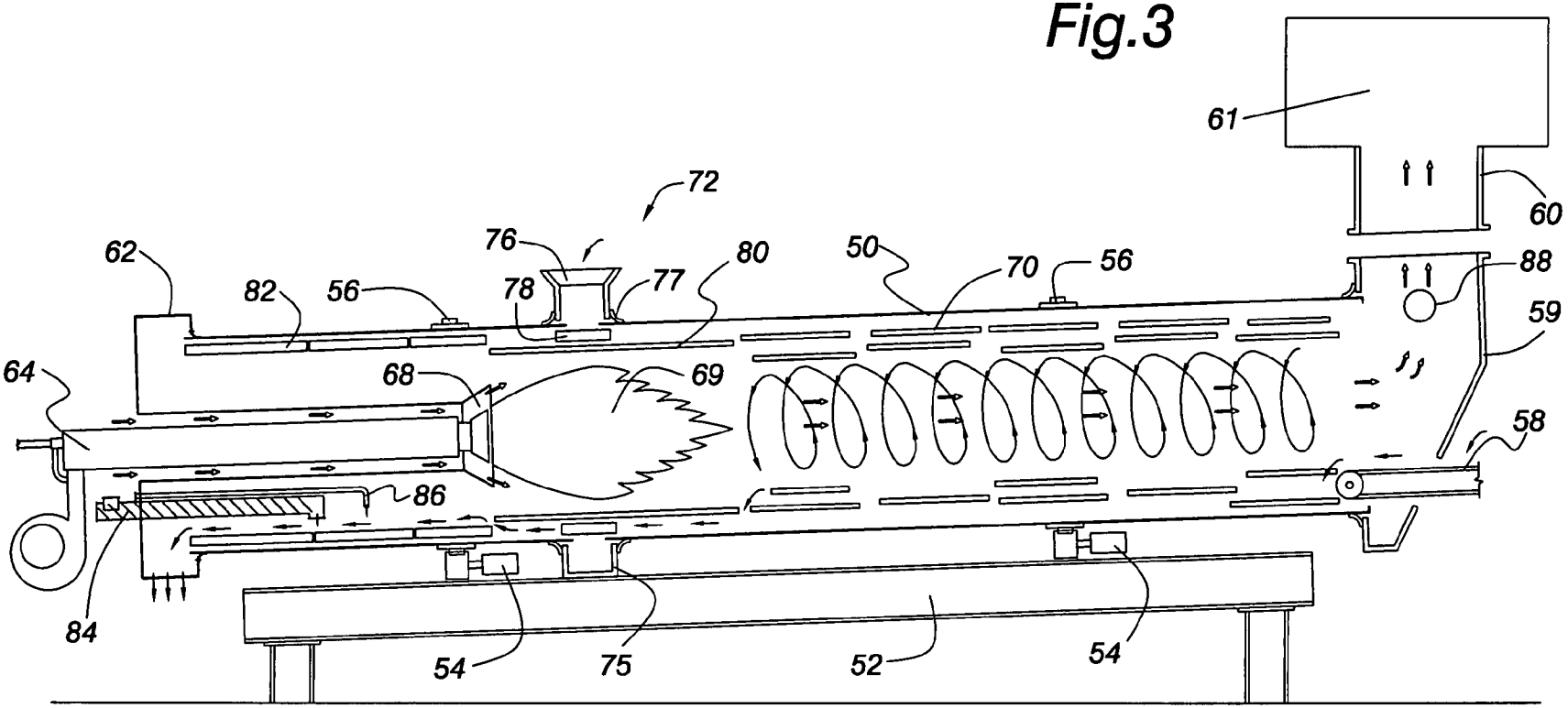
FIG. 3 is an enlarged, side sectional view of a counter-flow asphalt plant similar to FIG. 2 to better illustrate the details of construction and pertinent operational features of the equipment.
Figure 5:
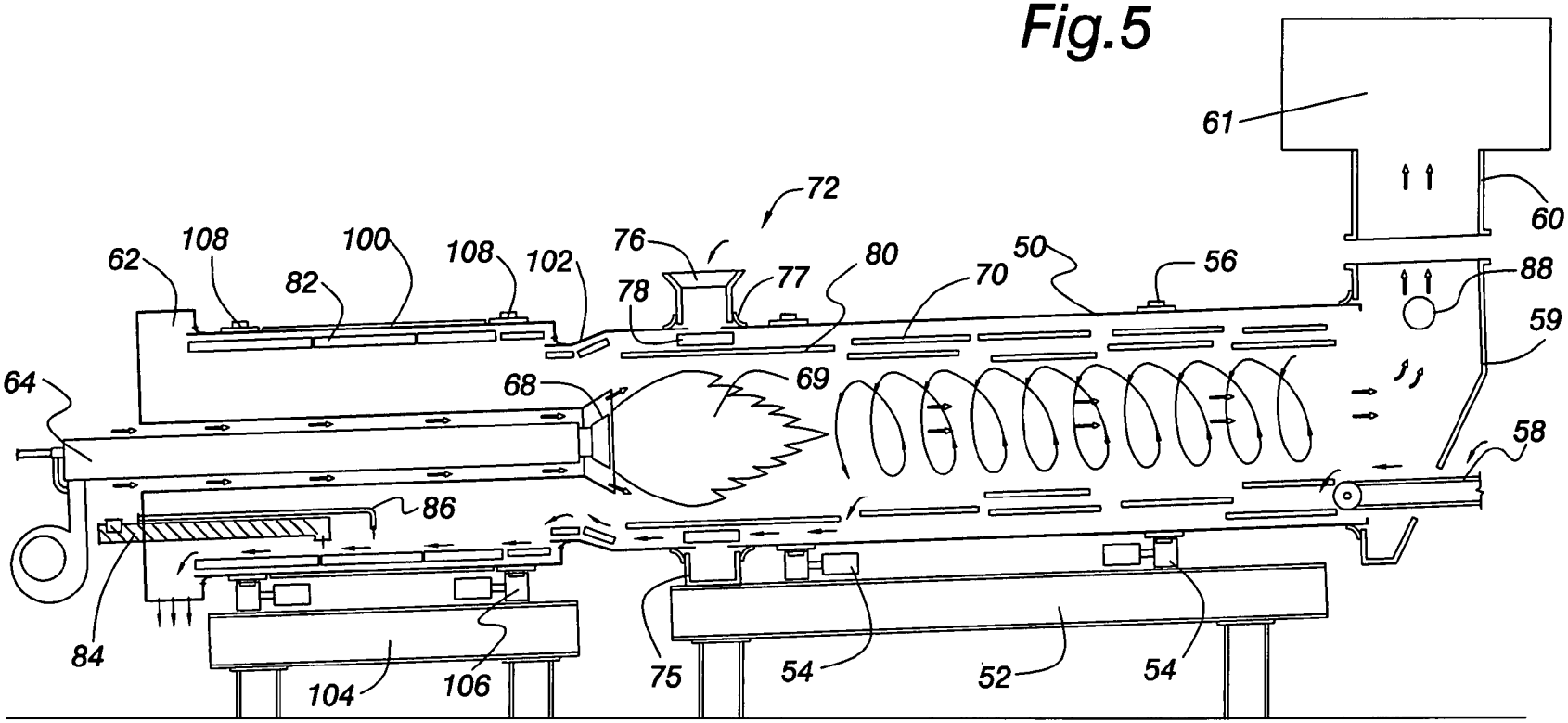
FIG. 5 is a side sectional view of an independent mixer and dryer type of a counter-flow asphalt plant constructed in accordance with a second preferred embodiment of the invention.
Figures 6, 7:
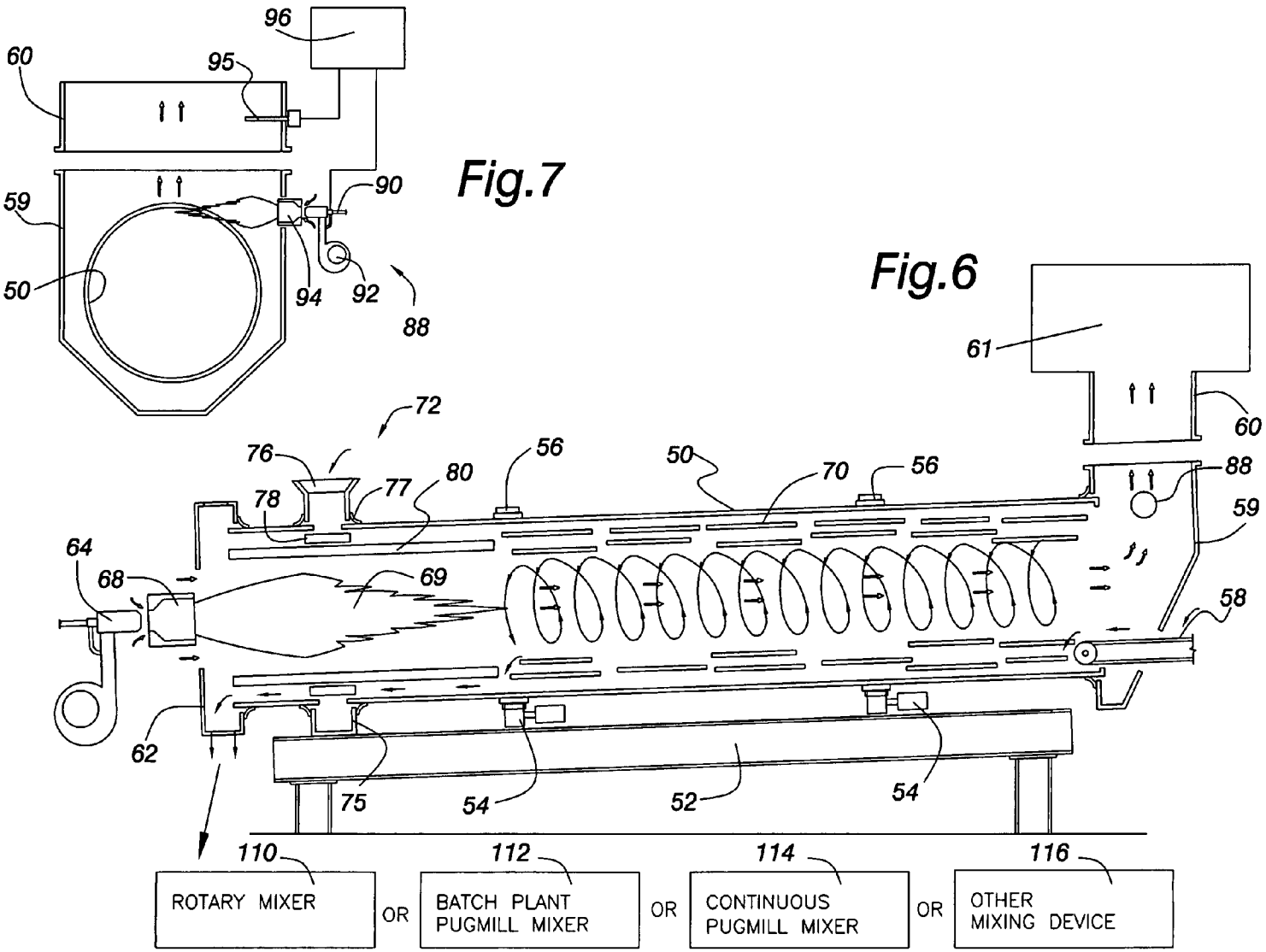
FIG. 6 is a side sectional view of a dryer for an asphalt plant constructed in accordance with a third preferred embodiment of the invention.
FIG. 7 is an end sectional view of a portion of the exhaust ductwork, the associated exhaust gas heater and a schematic illustration of the temperature control system as taken from the right hand end of FIG. 6.
Figure 9:
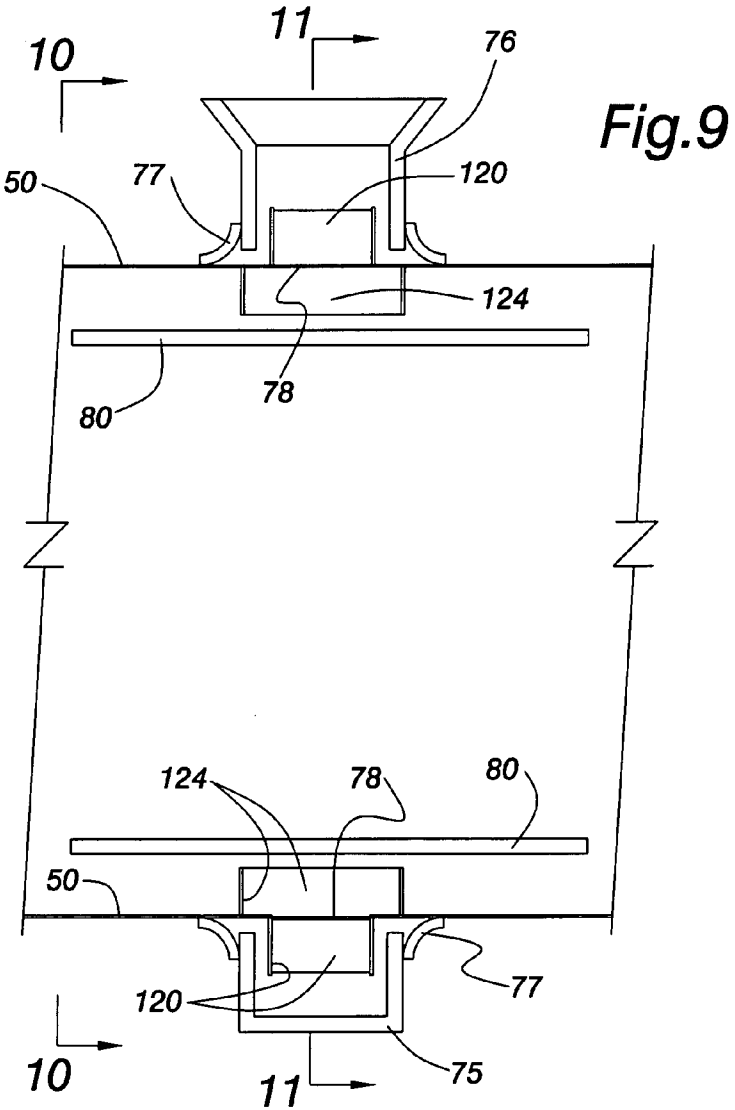
FIG. 9 is an enlarged side sectional view of the combustion zone recycle feed assembly shown in FIG. 8 to better illustrate the internal details of construction.
Figure 8:
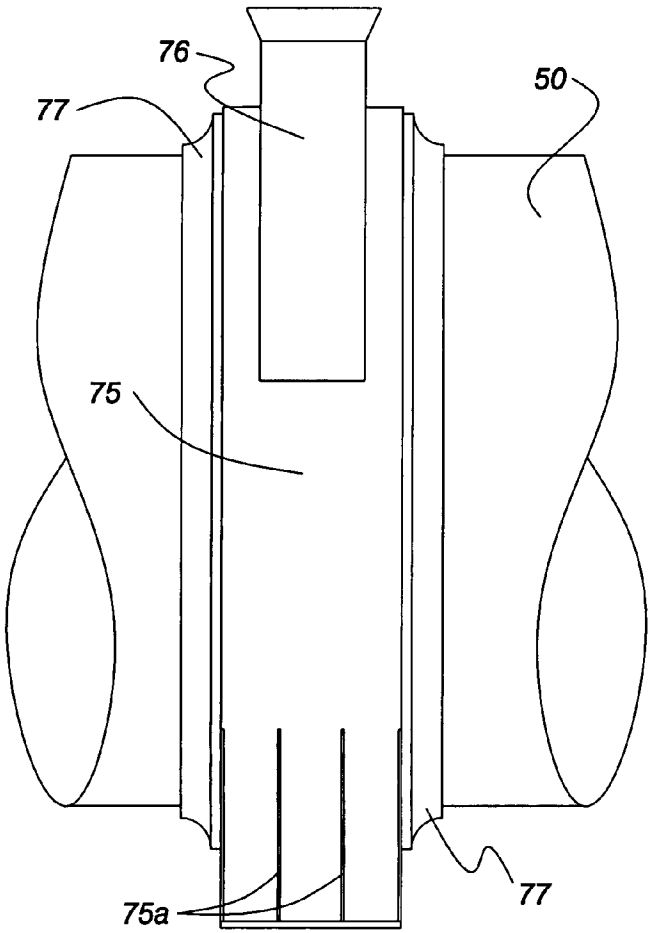
FIG. 8 is an enlarged side view of one preferred embodiment of a combustion zone recycle feed assembly and flighting for use with the asphalt equipment illustrated in the foregoing FIGS. 2–7.

With the foregoing background in mind, attention is now directed to the counter-flow asphalt plant constructed in accordance with a preferred embodiment of this invention as illustrated in FIGS. 2–20. As an overview, it should be noted that the inventive features taught herein may be adapted to a variety of asphalt plant equipment configurations. FIGS. 2–4 show an asphalt plant with a single cylinder drum serving as the heating/drying, combustion and mixing zones, FIG. 5 shows an asphalt plant with two separate cylinders with one serving as the heating/drying and combustion zones and the other serving as the mixing zone. And finally, FIGS. 6–7 show an asphalt plant with a single cylinder drum serving as the heating/drying and combustion zones with the mixing zone separately located in conventional asphalt plant processing units.

Turning then to the asphalt plant configuration shown in FIGS. 2–4, the counter-flow plant includes a substantially horizontal, single cylindrical drum 50 carried by a ground engaging support frame 52 at a slight angle of declination, typically about 5 degrees. Mounted on the frame 52 are two pairs of large, motor driven rollers 54 which supportingly receive trunnion rings 56 secured to the exterior surface of the drum 50. Thus, rotation of the drive rollers 54 engaging the trunnion rings 56 causes the drum 50 to be rotated about its central longitudinal axis.

Located at the inlet or upstream end of the drum 50 is an aggregate feeder 58 to deliver aggregate to the interior of the drum 50 from a storage hopper or stockpile (not shown). The inlet end of the drum 50 is closed by a flanged exhaust port 59 connected, as is schematically illustrated in FIG. 3, to ductwork 60 leading to conventional air pollution control equipment 61, such as a baghouse, to remove particulates from the exhaust gas stream.

Located at the outlet end of the drum 50 is a discharge housing 62 to direct asphaltic composition from the drum 50 to a material conveyor (not shown) for delivery of the final product to a storage bin or transporting vehicle.

A combustion assembly 64 extends through the discharge housing 62 and into the drum 50 to deliver fuel, primary air from a blower 66 and induced secondary air through an open annulus to a burner head 68. Combustion of the air and fuel within the combustion zone of the drum 50 which generally extends from the burner head 68 to the end of the flame envelope 69 generates a hot gas stream which flows through the drying zone of the drum 50. Within the drying zone, material flights 70 are secured to the interior surface of the drum 50 to lift, tumble, mix, and release aggregate material within the drum 50 to create a substantially continuous veil or curtain of falling material through which the hot gas stream passes in counter current flow to facilitate the drying and heating of the aggregate.

Conventional wisdom of asphalt plant design and operation positions the recycle feed downstream of the burner head as illustrated in FIG. 1. The present design departs from conventional wisdom, however, and locates the recycle feed assembly 72 upstream of the burner head 28 and intermediate the ends of the combustion zone. As will be later explained, the recycle feed assembly 72 may be utilized to introduce recycle asphalt material, virgin material, or a mixture of recycle and virgin material into the drum 50. A stationary box channel 75 encircles the exterior surface of the drum 50 and includes a feed hopper 76 providing access to the interior of the box channel 75. Bolted to the side walls of the box channel 75 are flexible seals 77 to permit rotation of the drum 50 within the encircling box channel 75. Thus, for example, recycle asphalt material may be delivered by conveyor (not shown) through the feed hopper 76, into the box channel 75 and subsequently introduced into the interior of the drum 50 through the scoop openings 78. Greater details with respect to the feed assembly 72 will be found in connection with the description of FIGS. 8–20.

Within the combustion zone are mounted a plurality of combustion flights 80 which are spaced apart from the interior surface of the drum shell 50 to provide an annulus region through which material may be carried. It is specifically important to this invention that the combustion flights 80 are nonveiling flights to prevent material from falling through the flame envelope 69, as distinguished from the dryer flights 70 which are veiling flights for the intended purpose of creating a continuous curtain of falling material in the heating/drying zone. Greater details with respect to the combustion flights 80 are also found in the description of FIGS. 8–20.

Downstream of the burner head 68 is a mixing zone within the drum 50. Mounted on the interior thereof are rows of mixer flighting 82 to mix and stir material within the annulus formed by the drum 50 and combustion assembly 64. An auger 84 extends into the drum 50 for feeding binder material or mineral "fines" to the mixing zone. Likewise extending into the drum 50 is an injection tube 86 for spraying liquid asphalt into the mixing zone. At the end of the mixing zone is located the discharge housing 62 as previously discussed through which the asphaltic product is discharged.

Unlike conventional counter-flow asphalt plants, the asphalt plant of this invention includes dual burners. Attention is now directed to the upstream portion of FIG. 3 and the end view of FIG. 4. A secondary combustion assembly 88 extends through the exhaust port housing 59 and into the exhaust gas stream to deliver fuel through supply line 90 and primary air from a blower 92 to a burner head 94. Combustion at the burner head 94 heats the exhaust gas stream to elevate the temperature thereof before delivery to the baghouse 61. It is desirable to maintain the temperature of the exhaust gas stream at or above its dew point prior to entry to the air pollution filtration equipment 61. More or less energy may be supplied to the exhaust gas stream by process control equipment known to those skilled in the art. Illustrated in the drawings is a schematic representation of one example which includes a temperature sensing thermocouple 95 installed in the exhaust port housing 59 or ductwork 60 to the baghouse 61. The thermocouple 95 is operatively connected to a process controller 96 which, in turn, is connected to the combustion assembly 88 for regulation of the fuel and air supply to support combustion in the exhaust gas stream.

Turning then to the asphalt plant configuration shown in FIG. 5, the counter-flow system includes two separate cylinders—a dryer cylinder 50 and a mixer cylinder 100—instead of a single cylinder configuration as previous described with reference to FIGS. 2–4. The dryer cylinder 50 serves as the heating/drying and combustion zones and the mixer cylinder serves as the mixing zone. Both the dryer cylinder 50 and the mixer cylinder 100 are supported on a support frame to variably control the mixer angle of declination with respect to the dryer angle of declination. The structural and operational details of such a split drum system is more fully illustrated and described in Hawkins U.S. Pat. No. 6,164,809, issued Dec. 26, 2000 and entitled "Counter-Flow Asphalt Plant with Independently Rotatable Dryer and Mixer," which is incorporated herein by reference.

In general, the counter-flow plant of FIG. 5 includes a substantially horizontal, dryer cylinder 50 carried by a ground engaging support frame 52 at a slight angle of declination. Mounted on the frame 52 are two pairs of large, motor driven rollers 54 which supportingly receive trunnion rings 56 secured to the exterior surface of the dryer cylinder 50. Thus, rotation of the drive rollers 54 engaging the trunnion rings 56 causes the dryer cylinder 50 to be rotated at a preselected speed about its central longitudinal axis.

Located at the inlet or upstream end of the dryer cylinder 50 is an aggregate feeder 58 to deliver aggregate to the interior of the dryer cylinder 50 from a storage hopper or stockpile (not shown). The inlet end of the dryer cylinder 50 is closed by a flanged exhaust port 59 connected, as is schematically illustrated in FIG. 5, to ductwork 60 leading to conventional air pollution control equipment 61, such as a baghouse, to remove particulates from the exhaust gas stream.

The outlet end of the dryer cylinder 50 is formed as a frusto-conical section 102 with a discharge mouth inserted in the upstream end of the mixer cylinder 100. Rotation of the dryer 50 causes aggregate to travel up the frusto-conical section 102 to be fed interiorly of the mixer cylinder 100. The mixer cylinder 100 is carried at a mixer angle of declination on an adjustable support frame 104. By means of height adjustable jacks or similar mechanism 86, the mixer angle of declination may be increased or decreased relative to the dryer angle of declination.

Mounted on the support frame 104 are variable, mixer drive rollers 106 which supportingly receive trunnion rings 108 secured to the exterior surface of the mixer cylinder 100. Thus, rotation of the drive rollers 106 engaging the trunnion rings 108 causes the mixer cylinder 100 to be rotated at a preselected, but variable speed about the central longitudinal mixer axis. Accordingly, both the rotational speeds and the angles of declination of the dryer cylinder 50 and the mixer cylinder 100 may be independently preselected and varied.

Located at the outlet end of the mixer cylinder 100 is a discharge housing 62 to direct asphaltic composition from the mixer cylinder 100 to a material conveyor (not shown) for delivery of the final product to a storage bin or transporting vehicle.

A combustion assembly 64 extends through the discharge housing 62, through the mixer cylinder 100 and into the dryer cylinder 50 to deliver fuel, primary air from a blower 66 and induced secondary air through an open annulus to a burner head 68. Combustion of the air and fuel within the combustion zone of the dryer cylinder 50 which generally extends from the burner head 68 to the end of the flame envelope 69 generates a hot gas stream which flows through the drying zone of the dryer cylinder 50. Within the drying zone, material flights 70 are secured to the interior surface of the dryer cylinder 50 to lift, tumble, mix, and release aggregate material within the dryer cylinder 50 to create a substantially continuous veil or curtain of falling material through which the hot gas stream passes in counter current flow to facilitate the drying and heating of the aggregate.

Conventional wisdom of asphalt plant design and operation would ordinarily require delivery of recycle material directly to the mixer cylinder 100. This is what is taught in Hawkins U.S. Pat. No. 6,164,809, issued Dec. 26, 2000 and entitled "Counter-Flow Asphalt Plant with Independently Rotatable Dryer and Mixer." The present design departs from such conventional wisdom, however, and locates the recycle feed assembly 72 upstream of the burner head 28 and intermediate the ends of the combustion zone. As will be later explained, the recycle feed assembly 72 may be utilized to introduce recycle asphalt material, virgin material, or a mixture of recycle and virgin material into the dryer cylinder 50. A stationary box channel 75 encircles the exterior surface of the dryer cylinder 50 and includes a feed hopper 76 providing access to the interior of the box channel 75. Bolted to the side walls of the box channel 75 are flexible seals 77 to permit rotation of the dryer cylinder 50 within the encircling box channel 75. Thus, for example, recycle asphalt material may be delivered by conveyor (not shown) through the feed hopper 76, into the box channel 75 and subsequently introduced into the interior of the dryer cylinder 50 through the scoop openings 78. Greater details with respect to the feed assembly 72 will be found in connection with the description of FIGS. 8–20.

Within the combustion zone are mounted a plurality of combustion flights 80 which are spaced apart from the interior surface of the drum shell 50 to provide an annulus region through which material may be carried. It is specifically important to this invention that the combustion flights 80 are nonveiling flights to prevent material from falling through the flame envelope 69, as distinguished from the dryer flights 70 which are veiling flights for the intended purpose of creating a continuous curtain of falling material in the heating/drying zone. Greater details with respect to the combustion flights 80 are also found in the description of FIGS. 8–20.

Downstream of the burner head 68 is, of course, located the mixing zone formed by the mixer cylinder 100. Mounted on the interior thereof are rows of mixer flighting 82 to mix and stir material within the annulus formed by the mixer cylinder 100 and combustion assembly 64. An auger 84 extends into the dryer cylinder 50 for feeding binder material or mineral "fines" to the mixing zone. Likewise extending into the drum 50 is an injection tube 86 for spraying liquid asphalt into the mixing zone. At the end of the mixing zone is located the discharge housing 62 as previously discussed through which the asphaltic product is discharged.

Similar to the structure previously described with reference to FIGS. 2–4, the asphalt plant of FIG. 5 also includes a secondary combustion assembly 88 which extends through the exhaust port housing 59. In other words, the view of FIG. 4 and its associated description are equally applicable to the structure of FIG. 5. Combustion provided by the assembly 88 adds energy to the exhaust gas to elevate the temperature thereof before delivery to the baghouse 61. It is desirable to maintain the temperature of the exhaust gas stream at or above its dew point prior to entry to the air pollution filtration equipment 61.

Turning next to the asphalt plant configuration shown in FIGS. 6–7, there is illustrated a dryer drum for an asphalt plant utilizing the foregoing principles of this invention in a plant configuration which could likely be encountered in a retrofit or modification of existing equipment. The asphalt plant includes a substantially horizontal, dryer drum 50 carried by a ground engaging support frame 52 at a slight angle of declination, typically about 5 degrees. Mounted on the frame 52 are two pairs of large, motor driven rollers 54 which supportingly receive trunnion rings 56 secured to the exterior surface of the drum 50. Thus, rotation of the drive rollers 54 engaging the trunnion rings 56 causes the drum 50 to be rotated about its central longitudinal axis.

Located at the inlet or upstream end of the drum 50 is an aggregate feeder 58 to deliver aggregate to the interior of the drum 50 from a storage hopper or stockpile (not shown). The inlet end of the drum 50 is closed by a flanged exhaust port 59 connected, as is schematically illustrated in FIG. 6, to ductwork 60 leading to conventional air pollution control equipment 61, such as a baghouse, to remove particulates from the exhaust gas stream.

Located at the outlet end of the drum 50 is a discharge housing 62 to direct heated and dried material from the drum 50 to a material conveyor (not shown) for delivery to a further processing unit in the asphalt plant such as a rotary mixer 110, a batch plant pugmill mixer 112, a continuous pugmill mixer 114, or other mixing device 116. In such subsequent mixing equipment, it is contemplated that the heated and dried material from the drum 50 will be combined with liquid asphalt and any necessary additives for final production of the desired asphalt mix composition.

A combustion assembly 64 is positioned at the end of the dryer drum 50 and extends through the discharge housing 62 to deliver fuel, primary air from a blower 66 and induced secondary air through an open annulus to a burner head 68. Combustion of the air and fuel within the combustion zone of the drum 50 which generally extends from the burner head 68 to the end of the flame envelope 69 generates a hot gas stream which flows through the drying zone of the drum 50. Within the drying zone, material flights 70 are secured to the interior surface of the drum 50 to lift, tumble, mix, and release aggregate material within the drum 50 to create a substantially continuous veil or curtain of falling material through which the hot gas stream passes in counter current flow to facilitate the drying and heating of the aggregate.

Conventional wisdom of asphalt plant design and operation of the arrangement shown in FIG. 6 would require any recycle feed to be combined with hot virgin material after it exits the dryer 50. In other words, RAP would characteristically be introduced directly into the mixing step downstream of the dryer 50 itself. The present design departs from conventional wisdom, however, and locates the recycle feed assembly 72 upstream of the burner head 28 and intermediate the ends of the combustion zone. As will be later explained, the recycle feed assembly 72 may be utilized to introduce recycle asphalt material, virgin material, or a mixture of recycle and virgin material into the drum 50.

A stationary box channel 75 encircles the exterior surface of the drum 50 and includes a feed hopper 76 providing access to the interior of the box channel 75. Bolted to the side walls of the box channel 75 are flexible seals 77 to permit rotation of the drum 50 within the encircling box channel 75. Thus, for example, recycle asphalt material may be delivered by conveyor (not shown) through the feed hopper 76, into the box channel 75 and subsequently introduced into the interior of the drum 50 through the scoop openings 78. Greater details with respect to the feed assembly 72 will be found in connection with the description of FIGS. 8–20.

Within the combustion zone are mounted a plurality of combustion flights 80 which are spaced apart from the interior surface of the drum shell 50 to provide an annulus region through which material may be carried. It is specifically important to this invention that the combustion flights 80 are nonveiling flights to prevent material from falling through the flame envelope 69, as distinguished from the dryer flights 70 which are veiling flights for the intended purpose of creating a continuous curtain of falling material in the heating/drying zone. Greater details with respect to the combustion flights 80 are also found in the description of FIGS. 8–20.

Unlike conventional counter-flow asphalt plants, the asphalt plant of this invention includes dual burners. Attention is now directed to the upstream portion of FIG. 6 and the end view of FIG. 7. A secondary combustion assembly 88 extends through the exhuast port housing 59 and into the exhaust gas stream to deliver fuel through supply line 90 and primary air from a blower 92 to a burner head 94. Combustion at the burner head 94 heats the exhaust gas stream to elevate the temperature thereof before delivery to the baghouse 61. It is desirable to maintain the temperature of the exhaust gas stream at or above its dew point prior to entry to the air pollution filtration equipment 61. More or less energy may be supplied to the exhaust gas stream by process control equipment known to those skilled in the art. Illustrated in the drawings is a schematic representation of one example which includes a temperature sensing thermocouple 95 installed in the exhaust port housing 59 or ductwork 60 to the baghouse 61. The thermocouple 95 is operatively connected to a process controller 96 which, in turn, is connected to the combustion assembly 88 for regulation of the fuel and air supply to support combustion in the exhaust gas stream.

Figure 11:
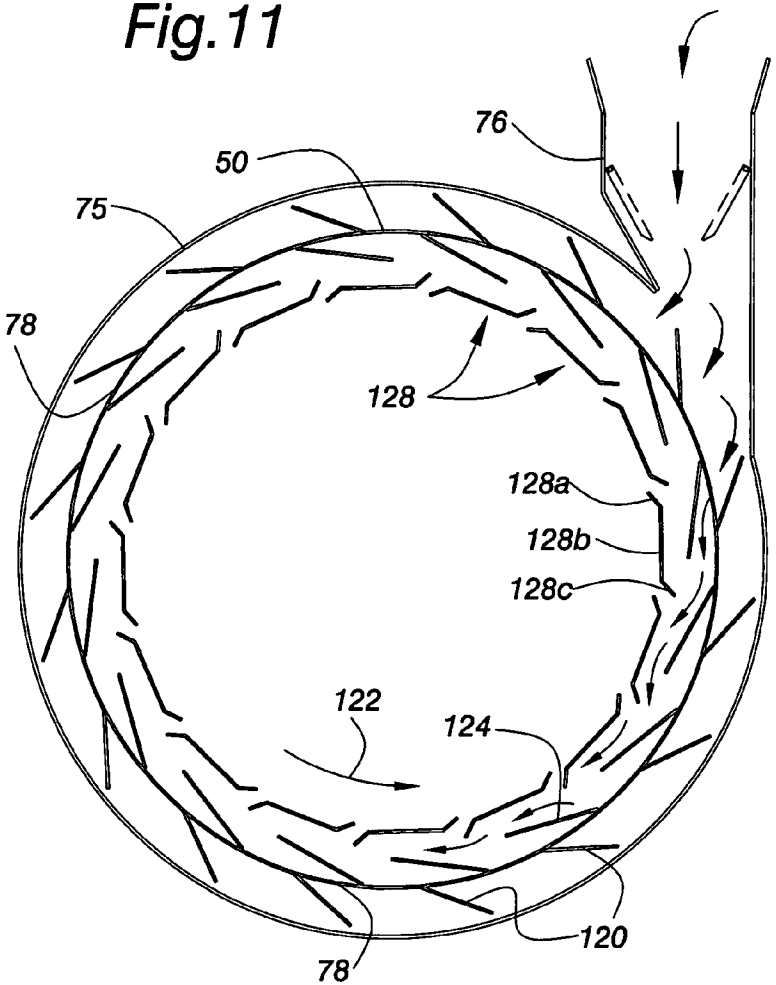
FIG. 11 is an end sectional view taken along line 11—11 of FIG. 9 in the direction of the arrows to better illustrate the details of the combustion zone fighting in relation to the internal details of the feed collar.
Figure 10:
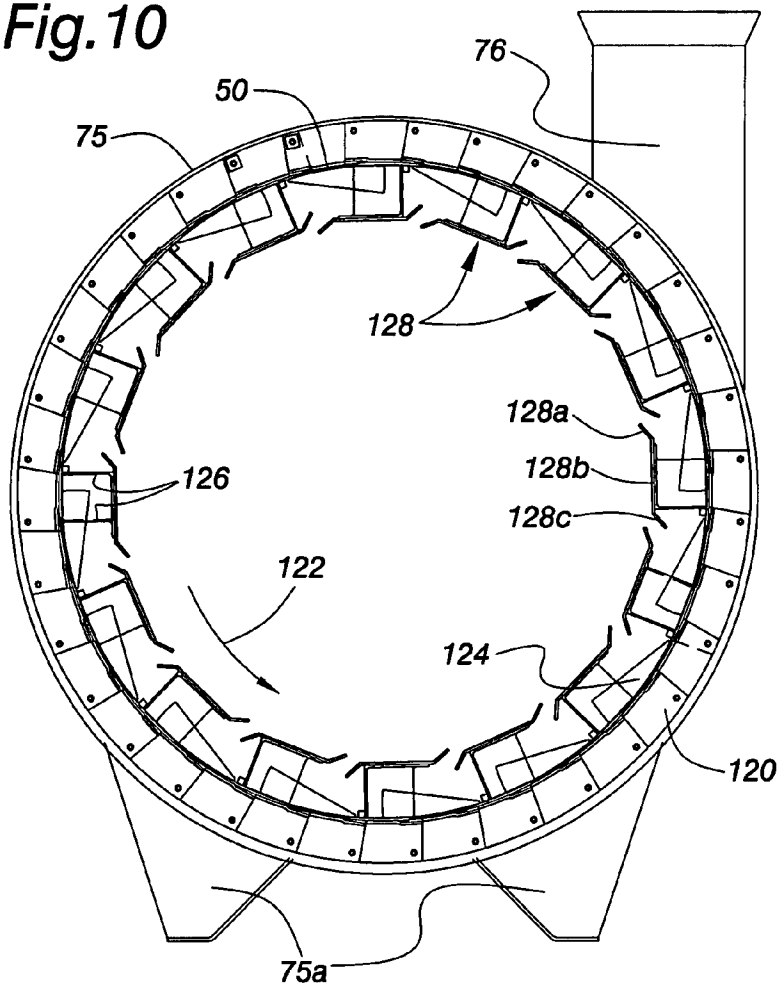
FIG. 10 is an end sectional view taken along line 10—10 of FIG. 8 in the direction of the arrows to better illustrate the details of the combustion zone flighting in relation to the internal details of the feed collar.
Figure 12:
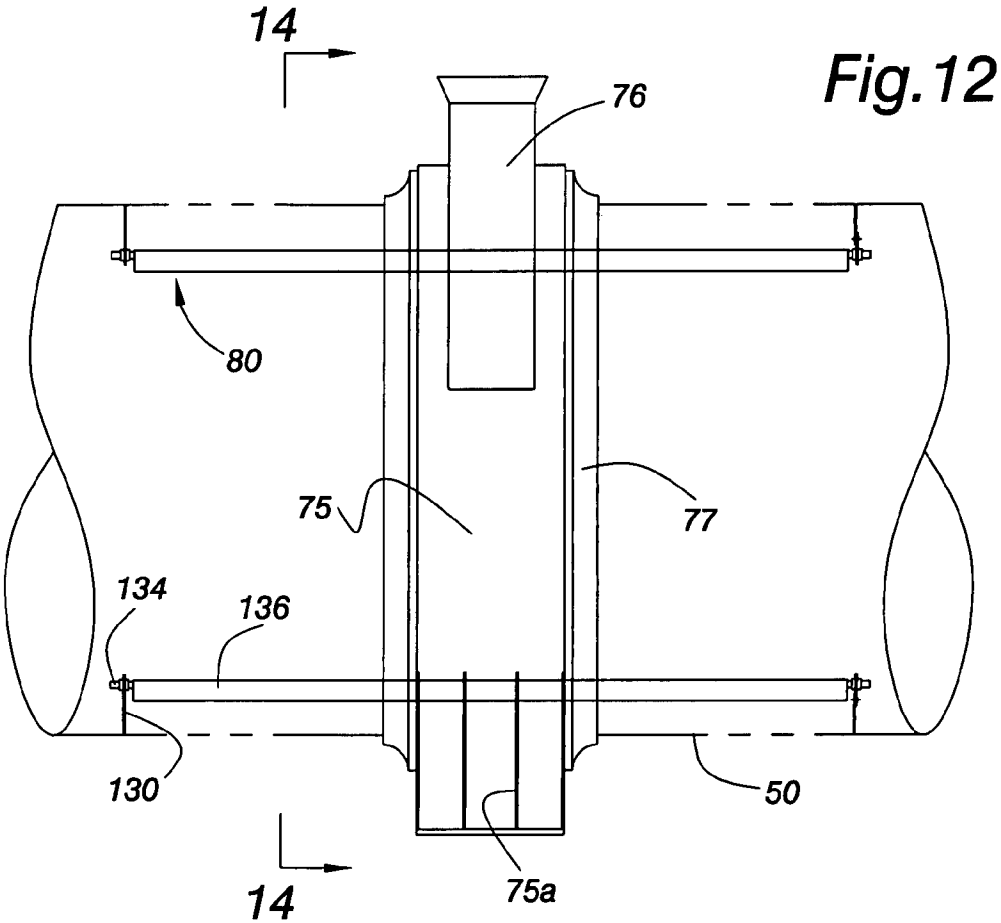
FIG. 12 is an enlarged side view of second preferred embodiment of a combustion zone recycle feed assembly and lighting for use with the asphalt equipment illustrated in the foregoing FIGS. 2–7.

Attention is now directed to the additional details of construction of the combustion flighting 70 and recycle feed assembly 72. A first preferred embodiment is shown in FIGS. 8–11. A stationary box channel 75 having support legs 75*a* encircles the exterior surface of the drum 50 and includes a feed hopper 76 providing access to the interior of the box channel 75. Secured to the side walls of the box channel 75 are flexible seals 77 to permit rotation of the drum 50 within the encircling box channel 75. A plurality of circumferential openings 78 through the shell of the drum are registered with the box channel 75. As best illustrated in FIGS. 10–11, scoop plates 120 are secured exteriorly of the drum shell 50 to frame three sides of each such opening 78 to direct material falling through the feed hopper 76 from the interior of the box channel 75 through an opening 78 into the interior of the drum shell 50. Note that a set of scoop plates 120 framing any opening 78 form a mouth which is open in the direction of rotation of the drum 50 as indicated by the arrow 122.

Secured interiorly of the drum shell 50 are trailing shields 124 which frame three sides of each such opening 78. Note that the trailing shields 124 framing any opening 78 form a cover or shield pointed in the direction opposite the rotation of the drum 50 so as to prevent material from falling from the interior of the drum 50 back into the box channel 75 when the associated opening 75 rotates through the bottom arc of travel.

A plurality of combustion flights 70 are secured to the interior surface of the drum shell 50 in the combustion zone substantially parallel to the rotational axis of the drum. Each combustion flight 70 includes a plurality of inwardly extended legs 126 on which is mounted a flighting plate 128. As viewed from the end as shown in FIG. 11 each flighting plate 128 is generally shaped in the form of a backward "S" which has an angled leading lip 128*a* directed inwardly from the main body portion 128*b*, and an angled trailing lip 128*c* directed outwardly from the main body portion 128*b*. It should be noted that adjacent combustion flights 70 are spaced slightly apart to provide air flow to the annulus formed between the combustion flights 70 and the interior of the drum shell 50. However, the leading lip 128*a* overlies the trailing lip 128*c* of the adjacent flighting plate 128 such that a ray drawn from the longitudinal axis of the drum 50 cannot extend into the annulus formed between the combustion flights 70 and the interior of the drum shell 50.

Accordingly, materials delivered through the feed hopper 76 are directed by the scoop plates 120 through the openings 78 in the drum shell 50 and are essentially captured between the interior of the drum shell 50 and the combustion flights 70. The configuration of the flighting plates 128 prevents direct radiant heat of the material while permitting convective and conductive heat transfer to the material. Since the recycle feed assembly 72 is located intermediate the ends of the combustion zone, any blue smoke generated as a result of the convective and conductive heat transfer can freely pass between adjacent combustion flights 70 to be incinerated in the flame envelope 69.

Figure 14:
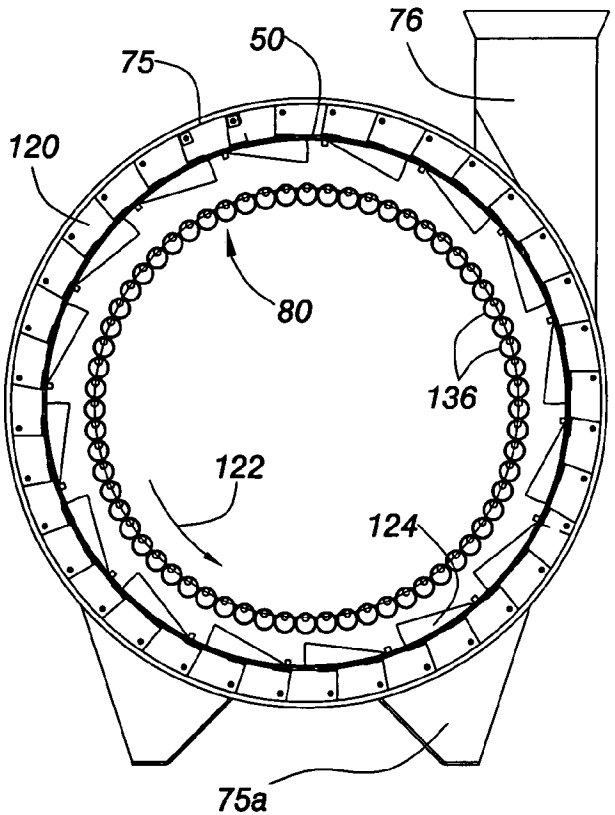
FIG. 14 is an end sectional view taken along line 14—14 of FIG. 12 in the direction of the arrows to better illustrate the details of the combustion zone fighting in relation to the internal details of the feed collar.
Figure 13:
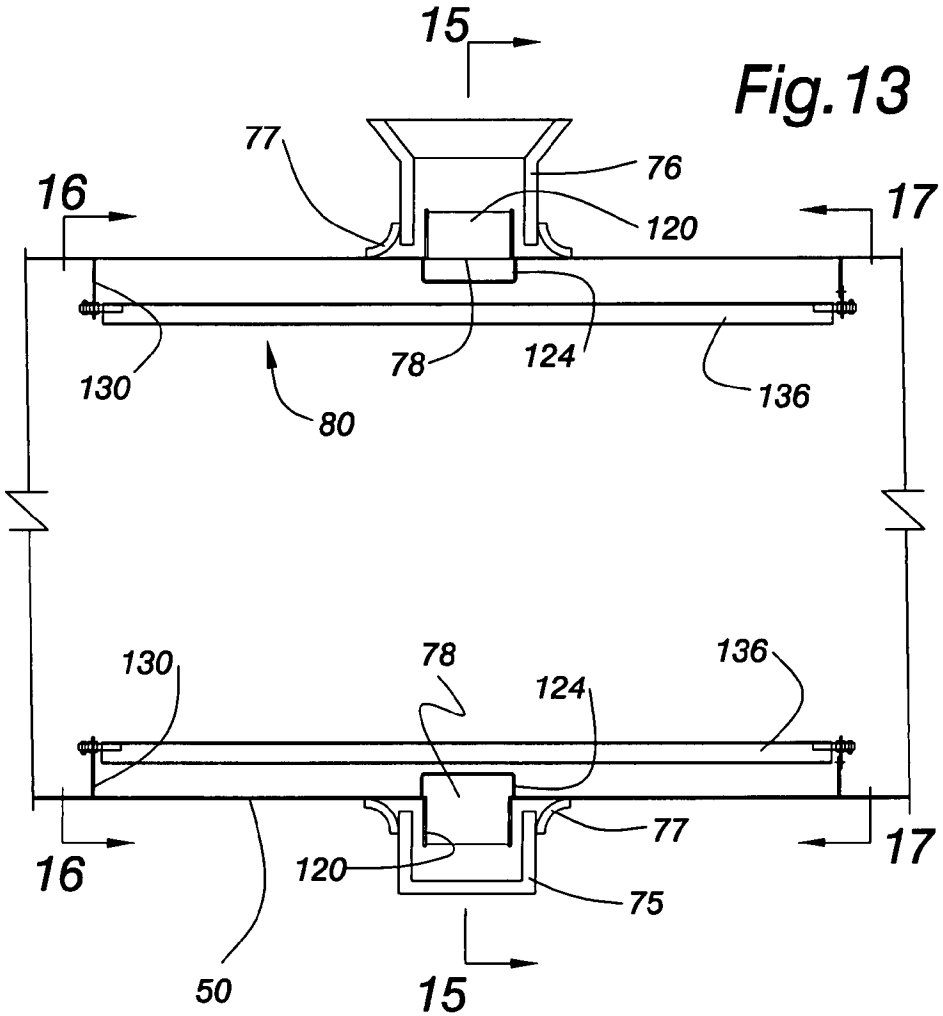
FIG. 13 is an enlarged side sectional view of the combustion zone recycle feed assembly shown in FIG. 12 to better illustrate the internal details of construction.
Figure 15:
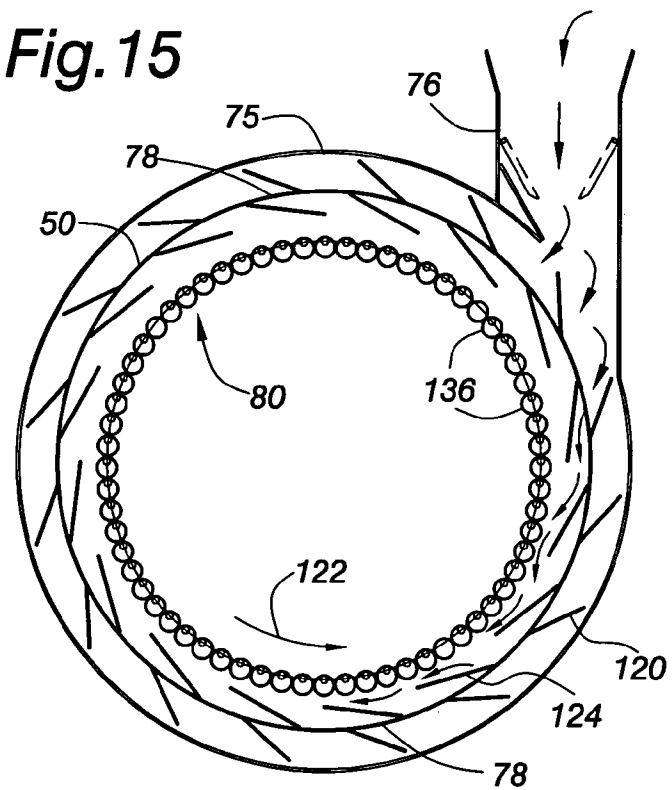
FIG. 15 is an end sectional view taken along line 15—15 of FIG. 13 in the direction of the arrows to better illustrate the details of the combustion zone fighting in relation to the internal details of the feed collar.
Figure 17:
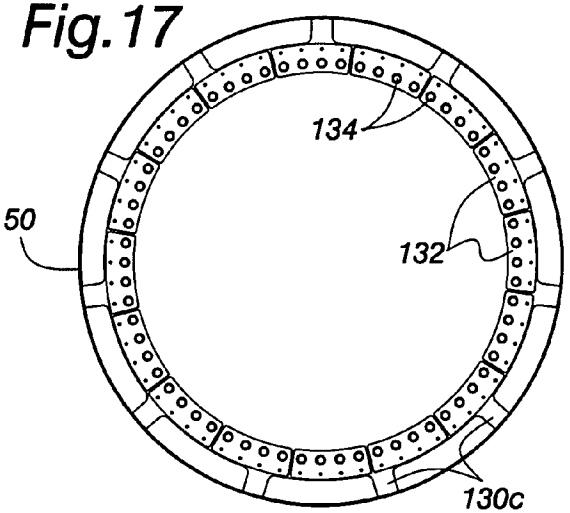
FIG. 17 is an end sectional view taken along line 17—17 of FIG. 13 in the direction of the arrows to illustrate the opposite end of the combustion flighting as shown in FIG. 16.
Figure 16:
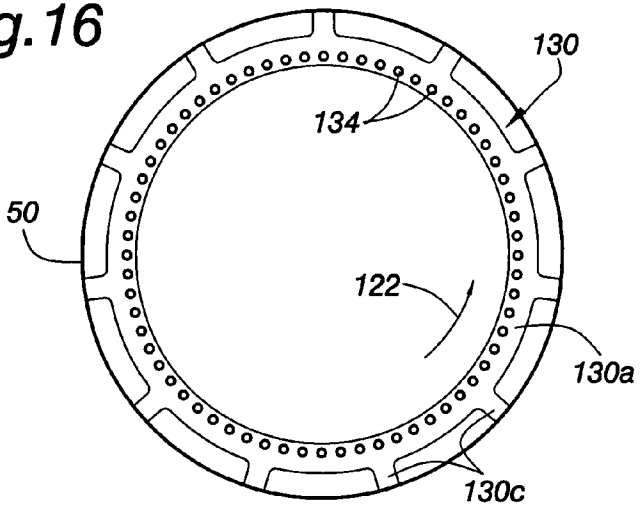
FIG. 16 is an end sectional view taken along line 16—16 of FIG. 13 in the direction of the arrows to illustrate one end of the combustion fighting.
Figure 20:
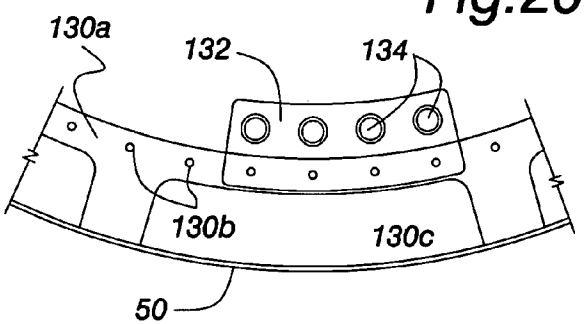
FIG. 20 is a fragmentary end view of the combustion fighting taken along line 20—20 of FIG. 18 in the direction of the arrows.
Figure 18:
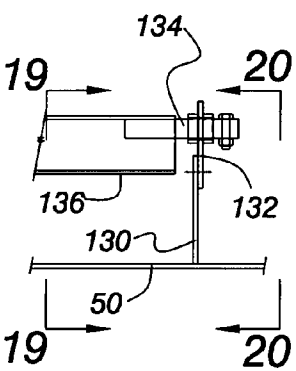
FIG. 18 is an enlarged fragmentary view of one end of a section of combustion flighting to better illustrate the mounting assembly of the fighting to the drum shell.
Figure 19:
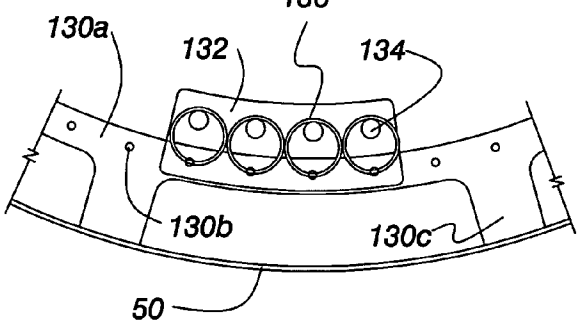
FIG. 19 is a fragmentary end view, partially sectional, of the combustion fighting taken along line 19—19 of FIG. 18 in the direction of the arrows.

A second preferred embodiment of the combustion flighting 70 and recycle feed assembly 72 is shown in FIGS. 12–20. Here is provided flighting to achieve the features and advantages previously envisioned and to also facilitate flighting replacement. A stationary box channel 75 having support legs 75*a* encircles the exterior surface of the drum 50 and includes a feed hopper 76 providing access to the interior of the box channel 75. Secured to the side walls of the box channel 75 are flexible seals 77 to permit rotation of the drum 50 within the encircling box channel 75. A plurality of circumferential openings 78 through the shell of the drum are registered with the box channel 75. As best illustrated in FIGS. 14–15, scoop plates 120 are secured exteriorly of the drum shell 50 to frame three sides of each such opening 78 to direct material falling through the feed hopper 76 from the interior of the box channel 75 through an opening 78 into the interior of the drum shell 50. Note that a set of scoop plates 120 framing any opening 78 form a mouth which is open in the direction of rotation of the drum 50 as indicated by the arrow 122.

Secured interiorly of the drum shell 50 are trailing shields 124 which frame three sides of each such opening 78. Note that the trailing shields 124 framing any opening 78 form a cover or shield pointed in the direction opposite the rotation of the drum 50 so as to prevent material from falling from the interior of the drum 50 back into the box channel 75 when the associated opening 75 rotates through the bottom arc of travel.

A plurality of combustion flights 70 are secured to the interior surface of the drum shell 50 in the combustion zone substantially parallel to the rotational axis of the drum. A radial spoke frame 130 is secured to the interior surface of the drum shell 50 adjacent the ends of the combustion flights 70. The spoke frame 130 includes a continuous ring 130*a* having a plurality of holes 130*b* therethrough which is spaced inwardly from the interior surface of the drum shell 50. Radially spaced attachment legs 130*c* support the continuous ring 130*a* from the drum shell 50. The region between successive legs 102*c* is open to permit material ingress and egress. Mounted on the continuous ring 130*a* in the mounting holes 130*b* are a plurality of upstanding plates 132, one of which is shown in the enlarged views of FIGS. 18–20. Removably received through holes in the upstanding plates 132 are extension posts 134 oriented parallel to the longitudinal axis of the drum 50. Each set of aligned pair of extension posts 134 receive and carry an elongate, open ended pipe 136. The pipes 136 are slightly larger in diameter than their associated extension posts 134 in order to permit movement thereon during rotation of the drum 50. Each such flighting pipe 136 touches its neighboring pipes 136 such that a ray drawn from the longitudinal axis of the drum 50 cannot extend into the annulus formed between the pipes 136 and the interior of the drum shell 50. However, there is sufficient looseness of fit between adjacent pipes 136 to permit air flow.

Accordingly, materials delivered through the feed hopper 76 are directed by the scoop plates 120 through the openings 78 in the drum shell 50 and are essentially captured between the interior of the drum shell 50 and the combustion flight pipes 136. The configuration of the flighting pipes 136 prevents direct radiant heat of the material while permitting convective and conductive heat transfer to the material. Since the recycle feed assembly 72 is located intermediate the ends of the combustion zone, any blue smoke generated as a result of the convective and conductive heat transfer can freely pass between adjacent combustion flight pipes 136 to be incinerated in the flame envelope 69.

The foregoing features of the invention both individually and in combination offer remarkable benefits to modern asphalt plant design, construction and operations. RAP material is introduced directly into the hottest area of the drum, but is shielded from direct flame impingement by the combustion flighting. High percentage RAP mixes (up to 50%) are now possible without excessive equipment shell temperatures or excessive exhaust gas temperatures. Any blue smoke formed in the combustion zone can still be incinerated without passing into the baghouse because the feed entry is positioned intermediate the ends of the combustion zone.

The recycle feed assembly can also be used to introduce both RAP material, virgin material or a combination of both in order to reduce $NO_X$ emissions. This is achieved by introducing the wet materials (RAP or virgin) at the hot part of the combustion zone. The steam produced by the moisture laden material acts to cool the combustion zone hereby reducing the formation of thermally produced $NO_X$.

Provision of a secondary burner for the exhaust gas stream permits precision control of the exhaust gas temperatures for maximum fuel efficiency. Equipment life is extended by eliminating the need to superheat virgin aggregates. Highly efficient heat transfer in the heating/drying zone of asphalt plant permits operations with the gas in the drying zone to sink as low as 180° F. with energy addition prior to delivery of the gas to the baghouse at or above its dew point in the range of 225° F. The plant operator can now standardize on the use of use of polyester bags (275° F. maximum service) rather than NOMEX (375° F. maximum service) bags to achieve a cost reduction of approximately 80%.

Likewise, the features of this invention alternatively permit either increased production or decreased sizes of the equipment required for a given production rate because both the BTU and CFM requirements are reduced. These highly significant advantages and benefits can be understood with reference to the following sizing calculations table.

SIZING CALCULATIONS TABLE

Calculation Assumptions: Counter-flow Drum, 650' Elevation, #2 Fuel Oil, 5% Moisture, 320° F. Mix, 900 FPM Drum Throughput, 3500 FPM Inlet Duct, 4400 FPM Stack 375 Degree Stack:

| TPH | BTU'S X 1,000,000 | DRYER DIA. | INLET DUCT DIA. | BAGHOUSE SIZE | STACK DIA. |
|---|---|---|---|---|---|
| 200 | 55.91 | 87.5" | 44.5" | 37,500 ACFM | 39.5" |
| 300 | 83.87 | 107" | 54.25" | 56,200 ACFM | 48.5" |
| 400 | 111.83 | 123.5" | 62.75" | 74,900 ACFM | 56" |
| 500 | 139.79 | 138" | 70" | 93,600 ACFM | 62.5" |
| 600 | 167.74 | 151.5" | 76.75" | 112,400 ACFM | 68.5" |

300 Degree Stack:

| TPH | BTU'S X 1,000,000 | DRYER DIA. | INLET DUCT DIA. | BAGHOUSE SIZE | STACK DIA. |
|---|---|---|---|---|---|
| 200 | 53.25 | 82" | 41.5" | 33,000 ACFM | 37" |
| 300 | 79.87 | 100.5" | 51" | 49,500 ACFM | 45.5" |
| 400 | 106.49 | 116" | 58.75" | 65,900 ACFM | 52.5" |
| 500 | 133.12 | 129.5" | 65.75" | 82,400 ACFM | 58.5" |
| 600 | 159.74 | 142" | 72" | 98,900 ACFM | 64" |

225 Degree Stack: 180 Degrees Dryer Exhaust Gas Temperature

| TPH | BTU'S X 1,000,000 | DRYER DIA. | INLET DUCT DIA. | BAGHOUSE SIZE | STACK DIA. |
|---|---|---|---|---|---|
| 200 | 50.74 | 73.5" | 39" | 28,800 ACFM | 34.75" |
| 300 | 76.11 | 89.75" | 47.5" | 43,100 ACFM | 42.5" |
| 400 | 101.48 | 103.5" | 55" | 57,500 ACFM | 49" |
| 500 | 126.85 | 115.75" | 61.5" | 71,900 ACFM | 54.75" |
| 600 | 152.22 | 127" | 67" | 86,200 ACFM | 60" |

By utilizing both the unique combustion entry RAP system combined with a dual burner configuration, in the example of a 50% recycle plant, such a system has a reduced size of the air handling equipment, including the dust collection system, by 20%, and the combustion equipment by 10%.

The size of the typical 400 ton per hour drum/dryer, for example, goes from 10'–3" diameter to 8'–8" diameter. The size of the baghouse filter collector on the same plant goes from a 75,000 ACFM capacity requirement to a 57,500 ACFM requirement. The size of the burner goes from 112 million BTU down to 101 million BTU. Such savings are heretofore unknown for modern asphalt plants.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

I claim:

1. A method for continuously drying and heating aggregate for an asphalt plant, the steps of said method comprising:

orienting in a substantially horizontal attitude a rotatable cylinder having first and second ends with an internal passageway communicating therebetween and having first and second zones, with each said zone having first and second ends;

rotating said cylinder;

delivering primary aggregate material to the first end of said cylinder whereby rotation of said cylinder transports said aggregate material from said first end of said cylinder, through said first and second zones, to said second end of said cylinder;

generating a hot gas stream in said second zone of said cylinder to flow toward said first end of said cylinder in a countercurrent direction to the flow of aggregate material within said cylinder in order to heat and dry the aggregate material within said first zone;

introducing secondary material directly within said second zone of said cylinder whereby rotation of said cylinder transports said secondary material through said second zone to said second end of said cylinder;

discharging said primary and secondary materials from said second end of said cylinder; and heating said hot gas stream discharged from the first end of said cylinder to elevate the temperature of said discharged hot gas stream prior to delivery to air pollution control equipment.

2. The method as set forth in claim 1, including the steps of creating a curtain of falling aggregate material within said first zone of said cylinder and flowing said hot gas stream through said curtain of falling aggregates to heat and dry the aggregate material.

3. The method as set forth in claim 1, including the step of preventing material from forming a curtain of falling material within said second zone of said cylinder.

4. The method as set forth in claim 3, including the step of shielding said secondary material from direct radiant heat in the second zone.

5. The method as set forth in claim 1 wherein said delivering step comprises delivering virgin aggregate material to the first end of said cylinder and said introducing step comprises introducing recycle asphalt material, virgin aggregate material or both recycle asphalt material and virgin aggregate material to said second zone of said cylinder.

6. The method as set forth in claim 1, including the steps of sensing the temperature of said discharged hot gas stream prior to delivery to air pollution control equipment and controlling said heating step to maintain said discharged hot gas stream prior to delivery to air pollution control equipment above its dew point temperature.

7. A method for continuously drying and heating aggregate for an asphalt plant, the steps of said method comprising:

orienting in a substantially horizontal attitude a rotatable cylinder having first and second ends with an internal passageway communicating therebetween and having first and second zones, with each said zone having first and second ends;

rotating said cylinder;

delivering primary aggregate material to the first end of said cylinder whereby rotation of said cylinder transports said aggregate material from said first end of said cylinder, through said first and second zones, to said second end of said cylinder;

generating a hot gas stream in said second zone of said cylinder to flow toward said first end of said cylinder in a countercurrent direction to the flow of aggregate material within said cylinder in order to heat and dry the aggregate material within said first zone;

heating said hot gas stream discharged from the first end of said cylinder to elevate the temperature of said discharged hot gas stream prior to delivery to air pollution control equipment; and discharging said primary material from said second end of said cylinder.

8. The method as set forth in claim 7, including the steps of sensing the temperature of said discharged hot gas stream prior to delivery to air pollution control equipment and controlling said heating step to maintain said discharged hot gas stream prior to delivery to air pollution control equipment above its dew point temperature.

9. A method for continuously producing an asphaltic composition from asphalt and aggregates, the steps of said method comprising:

orienting in a substantially horizontal attitude a rotatable cylinder having first and second ends with an internal passageway communicating therebetween and having first, second and third zones, with each said zone having first and second ends;

rotating said cylinder;

delivering primary aggregate material to the first end of said cylinder whereby rotation of said cylinder transports said aggregate material from said first end of said cylinder, through said first, second and third zones, to said second end of said cylinder;

generating a hot gas stream in said second zone of said cylinder to flow toward said first end of said cylinder in a countercurrent direction to the flow of aggregate material within said cylinder in order to heat and dry the aggregate material within said first zone;

introducing secondary material directly within said second zone of said cylinder whereby rotation of said cylinder transports said secondary material through said second and third zones, to said second end of said cylinder;

isolating said third zone of said cylinder from said hot gas stream;

mixing said primary aggregate material and said secondary material with liquid asphalt within said third zone isolated from said hot gas stream to produce an asphaltic composition;

discharging said asphaltic composition from said second end of said cylinder;

heating said hot gas stream discharged from the first end of said cylinder to elevate the temperature of said discharged hot gas stream prior to delivery to air pollution control equipment.

10. The method as set forth in claim 9, including the steps of creating a curtain of falling aggregate material within said first zone of said cylinder and flowing said hot gas stream through said curtain of falling aggregates to heat and dry the aggregate material.

11. The method as set forth in claim 9, including the step of preventing material from forming a curtain of falling material within said second zone of said cylinder.

12. The method as set forth in claim 11, including the step of shielding said secondary material from direct radiant heat from the second zone.

13. The method as set forth in claim 9 wherein said delivering step comprises delivering virgin aggregate material to the first end of said cylinder and said introducing step comprises introducing recycle asphalt material, virgin aggregate material or both recycle asphalt material and virgin aggregate material to said second zone of said cylinder.

14. The method as set forth in claim 9, including the steps of sensing the temperature of said discharged hot gas stream prior to delivery to air pollution control equipment and controlling said heating step to maintain said discharged hot gas stream prior to delivery to air pollution control equipment above its dew point temperature.

15. A method for continuously producing an asphaltic composition from asphalt and aggregates, the steps of said method comprising:

orienting in a substantially horizontal attitude a rotatable cylinder having first and second ends with an internal passageway communicating therebetween and having first, second and third zones, with each said zone having first and second ends;

rotating said cylinder;

delivering primary aggregate material to the first end of said cylinder whereby rotation of said cylinder transports said aggregate material from said first end of said cylinder, through said first, second and third zones, to said second end of said cylinder;

generating a hot gas stream in said second zone of said cylinder to flow toward said first end of said cylinder in a countercurrent direction to the flow of aggregate material within said cylinder in order to heat and dry the aggregate material within said first zone;

heating said hot gas stream discharged from the first end of said cylinder to elevate the temperature of said discharged hot gas stream prior to delivery to air pollution control equipment;

isolating said third zone of said cylinder from said hot gas stream;

mixing said aggregate material with liquid asphalt within said third zone isolated from said hot gas stream to produce an asphaltic composition; and discharging said asphaltic composition from said second end of said cylinder.

16. The method as set forth in claim 15, including the steps of sensing the temperature of said discharged hot gas stream prior to delivery to air pollution control equipment and controlling said heating step to maintain said discharged hot gas stream prior to delivery to air pollution control equipment above its dew point temperature.

* * * * *